US005542616A

United States Patent [19]

Archer

[11] Patent Number: 5,542,616

[45] Date of Patent: Aug. 6, 1996

[54] GRAIN-DE-ACIDIZING PROCESS MILL

[75] Inventor: Virgil L. Archer, Sanger, Tex.

[73] Assignee: Natural Pac Company, Hamburg, Ark.

[21] Appl. No.: 262,606

[22] Filed: Jun. 20, 1994

[51] Int. Cl.[6] ..... B02C 7/13; B02C 7/14; B02C 7/18; B02C 11/08

[52] U.S. Cl. ..... 241/62; 241/65; 241/162; 241/245; 241/259; 241/259.1; 241/261.1; 241/300; 241/DIG. 30

[58] Field of Search ..... 241/7, 8, 9, 12, 241/13, 41, 42, 43, 62, 65, 152.2, 160, 162, 222, 245, 246, 247, 257.1, 259, 259.1, 261.1, 300, DIG. 30

[56] References Cited

U.S. PATENT DOCUMENTS

| | | | |
|---|---|---|---|
| 6,644 | 8/1849 | Walker | 2341/DIG. 30 X |
| 175,535 | 3/1876 | Webber | 241/261.1 X |
| 962,543 | 6/1910 | Wyss | 241/261.1 |
| 2,173,975 | 9/1939 | Lyons | 241/DIG. 30 X |
| 2,212,082 | 8/1940 | Steinbarger | 241/261.1 |
| 5,271,570 | 12/1993 | Satake et al. | 241/8 X |

FOREIGN PATENT DOCUMENTS

| | | | |
|---|---|---|---|
| 824959 | 5/1981 | U.S.S.R. | 241/7 |
| 992085 | 1/1983 | U.S.S.R. | 241/7 |
| 1650246 | 5/1991 | U.S.S.R. | 241/7 |

*Primary Examiner*—Timothy V. Eley
*Attorney, Agent, or Firm*—W. H. Kintzinger; T. D. Copeland; D. W. Quimby

[57] ABSTRACT

Grain is fed from a hopper to a horizontally oriented adjustable speed steam heated auger driven by a variable speed drive. The auger is long enough (approximately twenty inches) that temperature controlled steam fed to a plurality of inlets along the auger as related to the rate of grain movement through the auger heats the grain therein to approximately three hundred degrees fahrenheit. Then it is dropped through a grain outlet opening into a high velocity cold air stream temperature shocking the hot grain causing a sudden contraction of grain outer layers causing them to crack and loosen from the grain core. The grain is then fed through tubes to space between a rotatable internally rubber (or soft plastic) sheet layer sheathed inner surface outer mill member fitted to and rotatable about a truncated cone member having outer surface metal channel members angled approximately forty five degrees adjacent at the top and diverging at the bottom. The grain is fed to and carried through a guide track with scrubber baffles and slightly corrugated along its length to an exit tube.

14 Claims, 5 Drawing Sheets

GRAIN-DE-ACIDIZING PROCESS MILL

SUMMARY OF THE INVENTION

This invention relates in general to grain mill processing, and more particularly, to a grain de-acidizing process and to the mill for the process.

Grain through the ages has been subject to many different milling processes and while good to some degree for their respective purposes they do not completely separate all the grain from the chaff. Grain also has high acid content portions that need to be completely eliminated from the grain (or berry). We have greatly advanced from the days of rubbing stones together but, heretofore, not as far as we would have liked. With some forms of grain there is an attach point and a black shield along with multiple layers of husk plus a coating of wax and also a germ all of which with, for example, the milo berry should be removed. This is accomplished by first quickly feeding and heating the berry outer portion to approximately three hundred degrees fahrenheit and then dropping the berry into a high velocity cold air stream to temperature shock the hot grain outer portion and causing a sudden contraction of the grain berry outer layers causing them to crack and loosen from the grain core. A rubbing action then separates the berry outer layers from the berry along with other portions to be removed. This includes the soft germ, a sticky substance following the black shield and other brand particles.

With respect to wheat the kernels, as processed through the de-acidizing mill, is in such form that a new type of flour can be made from the de-acidized kernel. The de-acidizer has precision controls accurate enough to remove the outerside layers of brand that are brown while leaving the inner transparent layer in place and delivering the whole berry undamaged. The whole berry with the transparent skin in place retains all the alerone powder in place including the wheat germ. When this whole berry is ground into flour the product becomes a white whole wheat flour without the bitters of the brown husk. The resulting flour is higher in fiber and more digestable because the aletone being included eliminates the harmful effect of gluten in the digestive track. Aletone is lost in the normal pre-existing milling process with crushing of the berry. The aletone that clings to the brand in earlier milling processes contains minerals and vitamins vital to digestion and balance against gluten (glue).

It is therefore a principal object of this invention to provide a grain de-acidizing process mill separating undesired parts of grain from the desired portion.

Another object is to efficiently loosen for removal of outer grain and berry coating portions via quick outer portion heating and then fast shock cooling sudden contraction causing outer layers to crack and loosen from the grain core.

A further object is to provide, after the grain temperature shock step, and means to feed the grain through a rubbing sequence as a further aid removal of husk layers.

Still another object is to provide a wheat kernel treatment process wherein the outside layers of brand, that are brown, are removed while leaving the inner transparent layers in place retaining all the aletone powder in place including the wheat germ.

Another object is for the whole berry of the proceeding object to, when ground into flour, produce a white whole wheat flour, without the bitters of the brown husk, higher in fiber and more digestable because the aletone included advantageously eliminates the harmful effect of gluten in the digestive track.

SUMMARY OF THE INVENTION

Features of this invention useful in accomplishing the above objects include, in a grain de-acidizing process and the mill used in the process, process feeding of grain from a hopper to a horizontally oriented adjustable speed steam heated auger driven by a variable speed drive with a grain travel time in the range of one half to one and one half seconds. The auger is long enough (approximately twenty inches) that temperature controlled steam fed to a plurality of inlets along the auger as related to the rate of grain movement through the auger heats the outer portion of the grain therein to approximately three hundred degrees fahrenheit. Then it is dropped through a grain outlet opening into a high velocity cold air stream temperature shocking the hot grain causing a sudden contraction of grain outer layers causes them to crack and loosen from the grain core. The grain is then fed through tubes to space between a rotatable internally surfaced rubber (or soft plastic) sheet layer sheathed inner surface outer mill member fitted to and rotatable about a truncated cone member having outer surface metal channel members angled approximately forty five degrees adjacent at the top and diverging at the bottom. The grain is fed therefrom to and carried through a guide track with scrubber baffles and including a slight corrugated surface along its length to an exit tube as a further aid to surface outer layer removal.

A specific embodiment representing what is presently regarded as the best mode of carrying out the invention is illustrated in the accompanying drawings.

Figure 1:
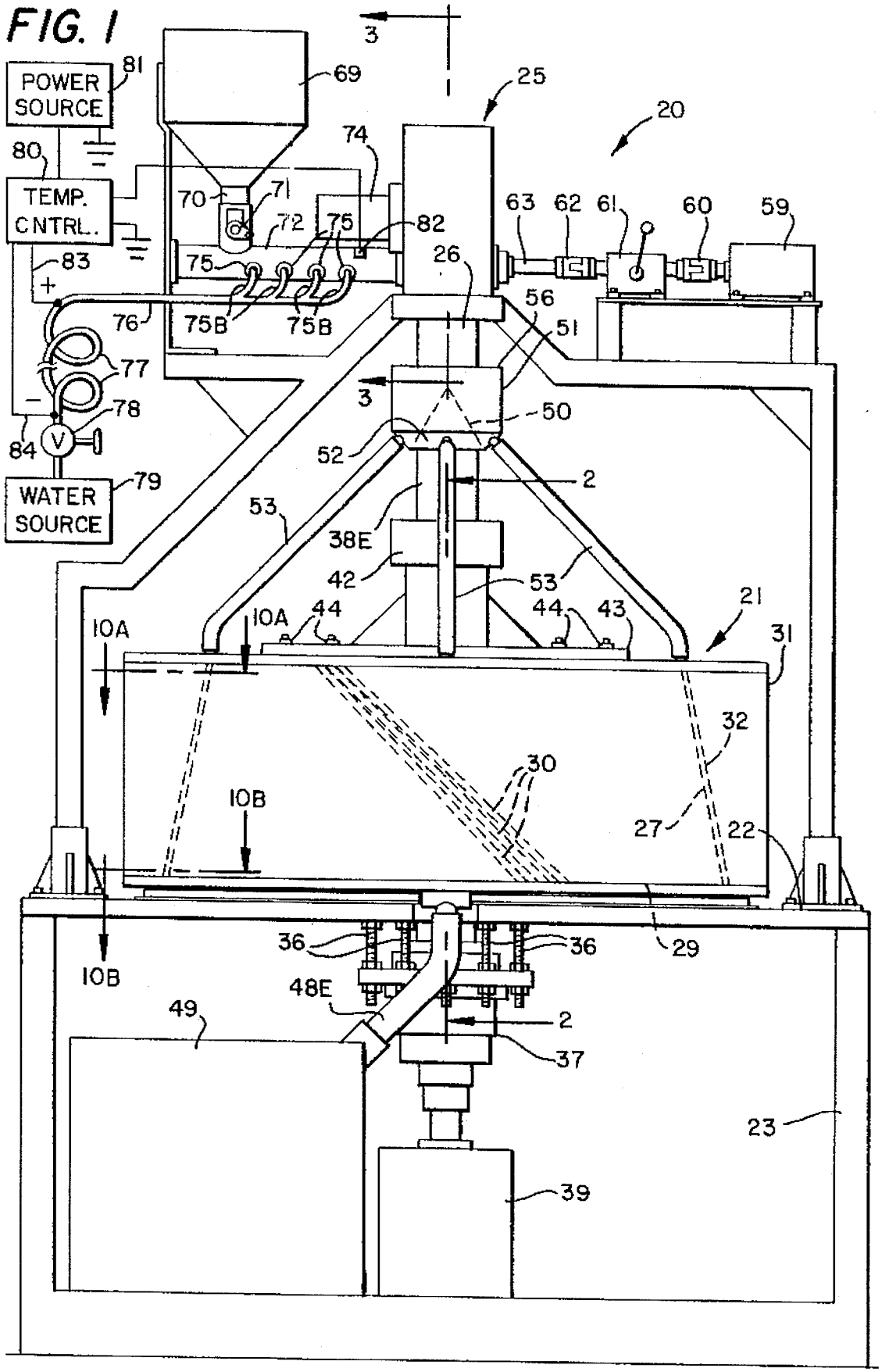
FIG. 1 represents a side elevation view of the new grain de-acidizing process mill with associated steam generating and temperature control system detail in partial block schematic form.
Figure 2:
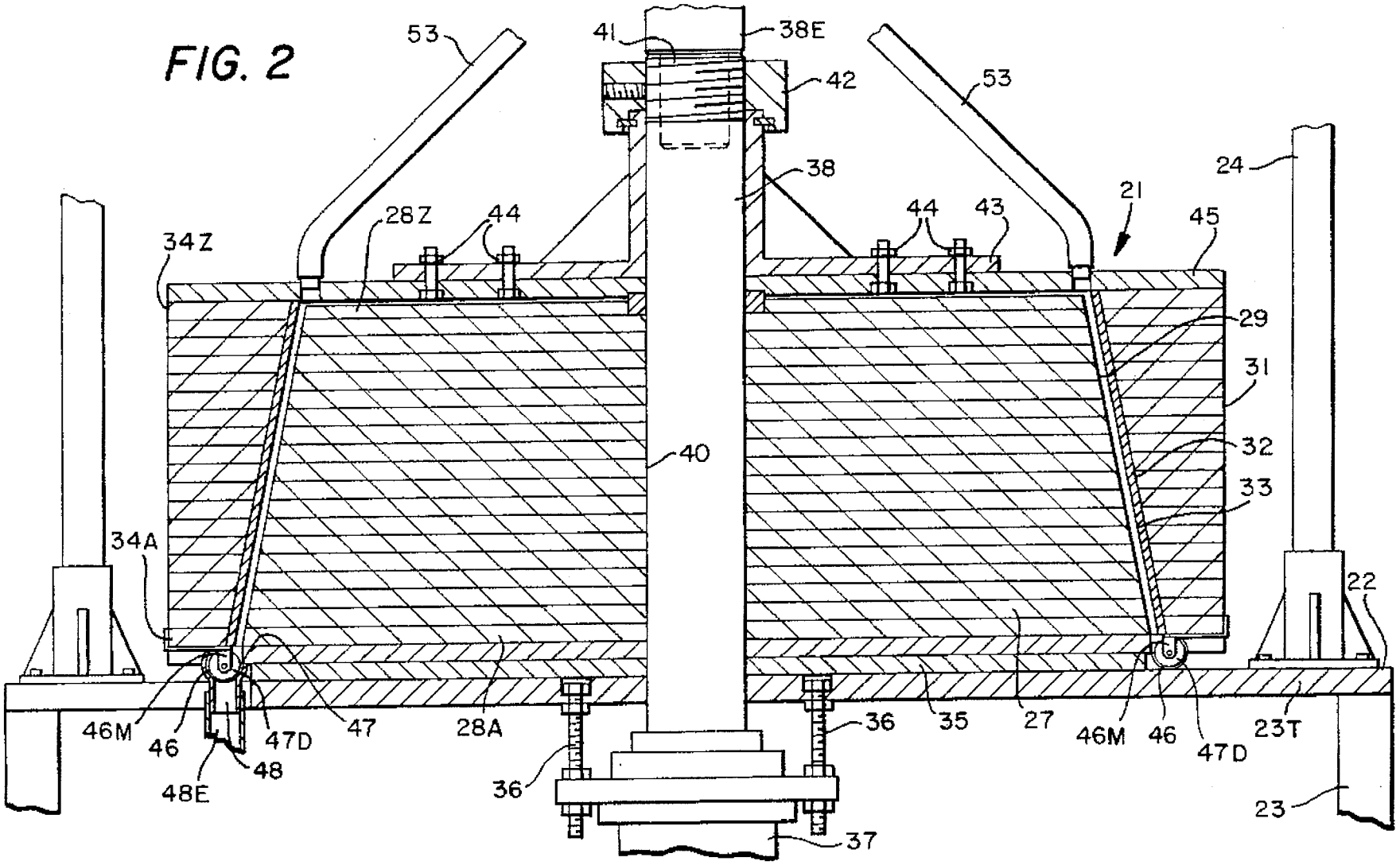
FIG. 2, a partial broken away and sectioned elevation view along line 2—2 of FIG. 1 of the grain rubbing portion of the mill.
Figure 3:
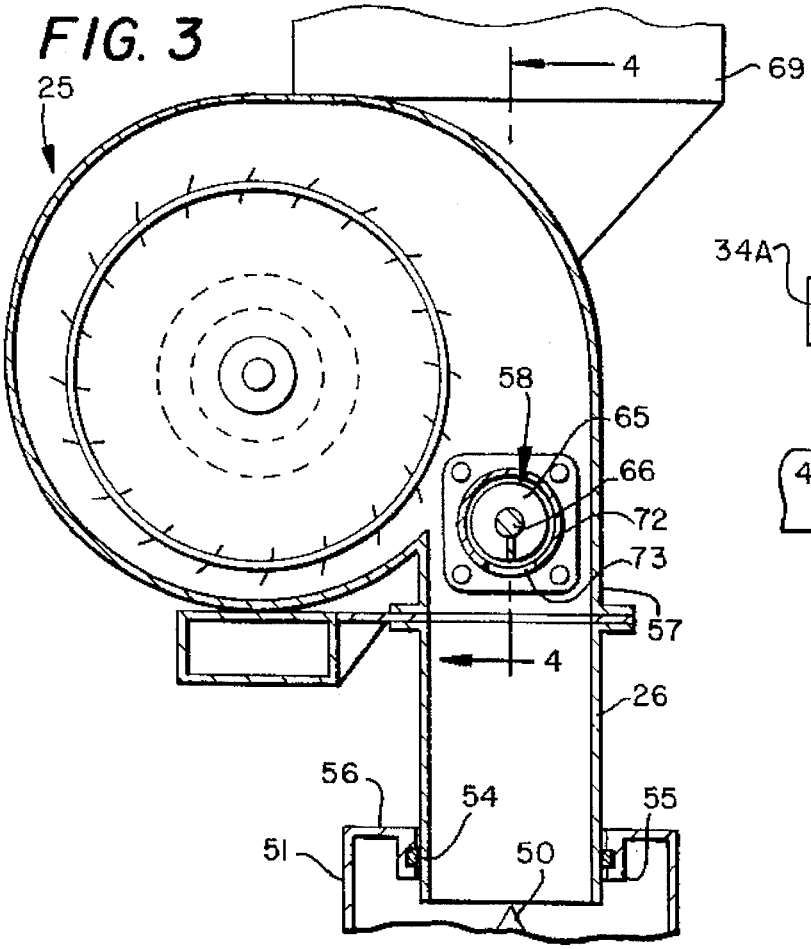
FIG. 3, a cut away and sectioned view, in elevation, taken along line 3—3 in FIG. 1 of the blower with grain feed hopper and auger.
Figure 5:
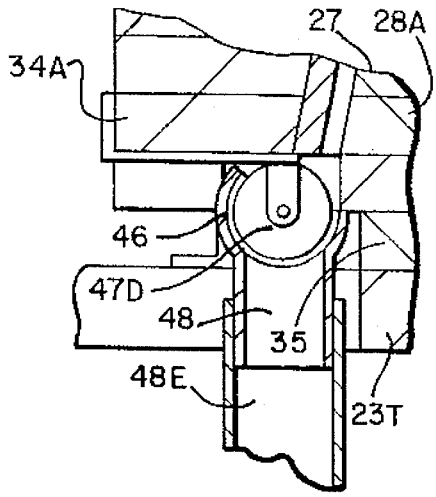
FIG. 5, a cut away an sectioned enlarged detail view of the FIG. 2 showing.
Figure 4:
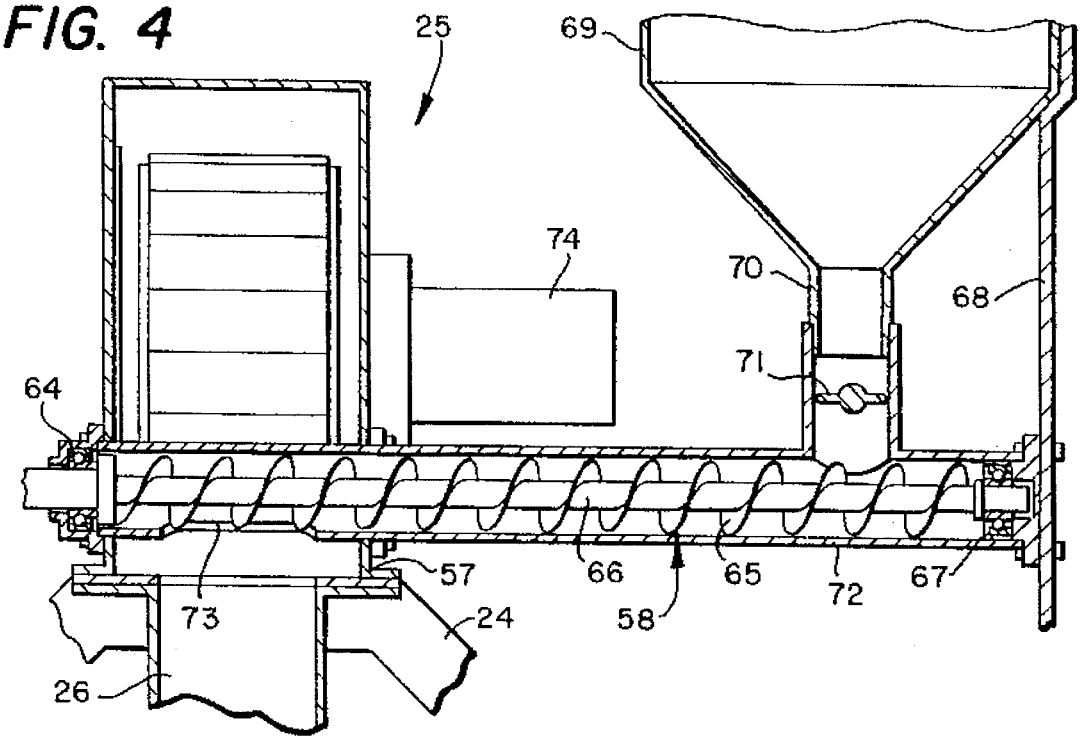
FIG. 4, a cut away and sectioned view along line 4—4 of FIG. 3 of the blower, the grain feed hopper and the feed auger.

Referring to the drawings:

DESCRIPTION OF THE PREFERRED EMBODIMENTS

The grain de-acidizing process mill 20 shown in FIG. 1 and detailed in FIGS. 2–5 and 8–10D is shown to have a mill grain rubbing portion 21 mounted on the top 22 of bottom frame section 23 that also supports upper frame section 24, The frame section 24 mounts a blower structure 25 above the mill grain rubbing portion 21 with a air blower output tube 26 centered with respect to the mill grain rubbing portion 21 therebelow.

The mill grain rubbing portion 21 includes a stationary truncated cone member 27 built primarily of bonded together wood layers 28A–Z having an outer conical surface 29 with outer surface metal channel members 30 that are angled approximately forty five degrees and curvilinear conformed to the conical surface 29 from adjacency at the top to divergent spacing at the bottom, An outer rotational grain rubbing member 31 has an internal truncated conical surface 32 fitted to member 27 and has an internally mounted rubber (or soft plastic) sheet layer 33 as a sheath bonded to the internal truncated conical surface 32. The sheet layer 33 is a single sheet of rubber approximately one quarter of an inch thick fitted to and bonded to the internal conical surface 32 formed in member 31 that is made up primarily of bonded together wood layers 34A–Z.

The cone member 27 has a bottom mount member 35 fixed in place on frame 23 top platform 23T. Multiple bolts 36 interconnect frame platform 23T and the outer non rotatable drive shaft connection enclosure 37 for drive shaft 38 from drive motor 39. Drive shaft 38 extends in a drive train upward through the center opening 40 of mill grain rubbing portion 21 to connection with a heighth and space adjusting threaded 41 structure 42 that has a circular bottom flange 43 bolted 44 to drive disk 45 of the outer rotational grain rubbing member 31 for the rotational drive thereof in a counter clockwise direction, looking from the top, to help move grain berries along grooves 30 top to bottom in a rubbing rolling dehusking action. This delivers the grain down to annular corrugated delivery trough 46 through which rubber wiper discs 47D (eight discs) slide with rotation of member 31 on the bottom of which they are mounted 46M to extend into and move along delivery trough 46, that has an annular top opening 47 therefor; to processed grain discharge tube 48 that along with extention tube 48E delivers the processed grain to dehusked de-acidized grain product container 49. Grain delivered to trough 46 is moved therealong from a short distance to as much as the length of the trough 46 by rubber scrubber baffle discs 47D travel around the total circumference thereof. The trough 46 is converted from a corrugated rubber tube with a longitudinal top opening 47 therein so that as the discs 47D push the grain around the delivery tube further scrubbing takes place completing the removal of any straggling pieces of brand or germ except with wheat where the inner transparent layer remains in place with all the aletone powder kept in place along with the wheat germ. The inner surface of the trough 46 with its corrugations increases the tumbling and scrubbing action as the grain is pushed by the disc 47D baffles around the trough 46 completing the removal of any straggling pieces of brand or germ from processed grain berries.

The upper drive train extension shaft 38E extends upward to and is the supporting mount for cone 50 and cone enclosure chamber cylinder 51 with a beveled 52 bottom directing grain flow to four grain delivery tubes 53 rotatable with the drive train shafts 38 and 38E, cone 50 and chamber cylinder 51 with the tubes 53 delivering grain to the top of the space between the stationary truncated cone member 27 and outer rotational grain rubbing member 31 internal truncated conical surface 32. Spacing between rubber sheath layer 33 and member 27 is adjustable by space adjusting structure 42 in the approximate range of from 0.069 inches to 0.096 inches as determined to some extent by grain berry size and with wheat the transparent wheat sheath to be retained on each wheat berry. The air blower output tube 26 extends down into chamber cylinder 51 through "O" ring seal 54 mounted in seal boss 55 on cylinder 51 top end 56 and that adapts to relative up and down adjustment movement therebetween and also relative rotation of the chamber cylinder 51.

A squirrel-cage scroll type blower 25 mounted on upper frame section 24 develops a high volume output cool air stream down air blower output tube 26 from blower output passage 57 into and through which a grain delivery auger 58 extends. The auger 58 is driven by motor 59 through a drive train including coupling 60, variable speed transmission 61, coupling 62 and auger drive shaft 63 on one side of blower 25. Shaft 63 is mounted in ball bearing 64 and the auger blade 65 is mounted on auger blade mount shaft 66 from bearing 64 to the outer ball bearing 67 mounted on a frame support extension 68 that also mounts grain feed bin 69 in a unified structure. The bin bottom spout 70 and the feed valve 71 are designed for fast feed of grain into the auger 58 at the auger grain feed end of auger containment cylinder 72. The auger blade 65 is driven at such speed as to move grain through a steam grain heating zone of the auger 58 the speed adjusted to somewhere in the range of one half second to one and one half seconds to grain discharge through auger containment cylinder 72 grain discharge opening 73. This time of grain movement through a steam heating zone in the auger 58 is adjusted to the temperature of steam delivered to the auger 58 and is volume and temperature controlled to bring the outer husk and wax layer of different grains up to approximately a three hundred degree Fahrenheit level without this level of heating being transmitted to the grain berry interior as they are moved therethrough. The grain then falls out through the grain delivery opening 73 into a relatively cold air stream from air pump 25 as driven by motor 74. The auger 58 including containment cylinder 72 is approximately twenty inches long and when the auger is rotating grain enters from the feed hopper (bin) 69 through spout 70 approximately two inches from the blind end of the auger blade 65. The grain travels approximately fourteen inches through the horizontal auger 58 before it drops through the port 73 in the bottom side of the auger tube 72. The auger tube 72 is provided with four steam entry ports 75 spaced along the grain travel portion of the tube 72 and four steam delivery tube branches 75B of steam tube 76 that has a water to steam heating coil 77 section connected through a valve 78 to water source 79. A temperature control 80 connected to power source 81 and to temperature sensor 82 located in the auger tube 72 on the outlet opening 73 side of steam entry ports 75 aids in control of grain outer husk area heating control to approximately three hundred degrees Fahrenheit with controlled power via positive line 83 and negative line 84 to opposite ends of steam generating heating tube coil 77. The hot grain falling from auger tube outlet opening 73 upon reaching the high velocity cold air is temperature change shocked causing a sudden contraction of the outer layers. As this happens the inner grain core does not shrink as much causing the outer layers (wax and brand) to crack and loosen themselves partially from the grain core. Then when the grain falls to the distribution cone 50 and is passed through grain delivery tubes 53 it is delivered into guide grooves 30 with the rotation of the mill member forcing the grain downward and angularly along the grooves 30. This with the outer rotary force of mill rotary member 31 rotates the grain in a 360° rotation and at the same time the guide track tries to rotate grain 360° on a different axis. As this occurs the friction created by the different surfaces one a rubber surface on rubber sheet layer 33 and the other an exposed side of a stainless steel perforated ribbon 85 in each track member 30 (i.e. outer surface channel members) causes the outer layers of brand to slip off the grain. With much of the grain treated such as with milo the soft germ is a sticky substance and it follows the black shield and other brand particles in the removal thereby of acid portions of the milo berry. The bulk of this occurs as the individual grain units move through the individual guide tracks, of a multiplicity of such guide tracks 30 with each approximately two feet long, the grain exits into the collector tube 46. In the tube 46 with its internal corrugations scrubber baffles 47D that travel around the tube 46 push the grain around the tube 46 with further scrubbing taking place completing the removal of any straggling pieces of brand or germ.

Figure 10A:
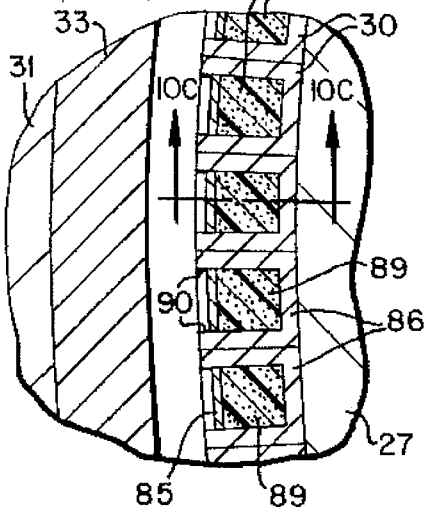
FIGS. 10A and 10B; taken from lines 10A—10A and 10B—10B, respectively, of FIG. 1, show detail of the rotatable internally rubber sheet layer surfaced outer mill member and the truncated cone member with outer surface metal channel grain members: and, FIGS. 10C and 10D taken from lines 10C—10C and 10D—107D of FIGS. 10A and 10B, respectively show detail of metal plates bonded to and resiliently backed by a rubber material in each of the grooves mounted on the truncated stationary portion in a grain rubbing portion of the mill.
Figure 10B:
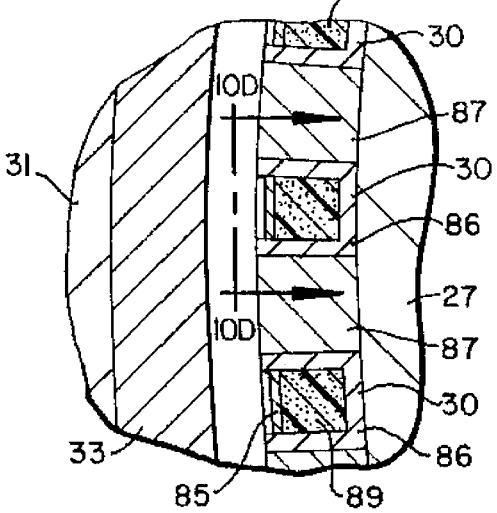
Figure 10C:
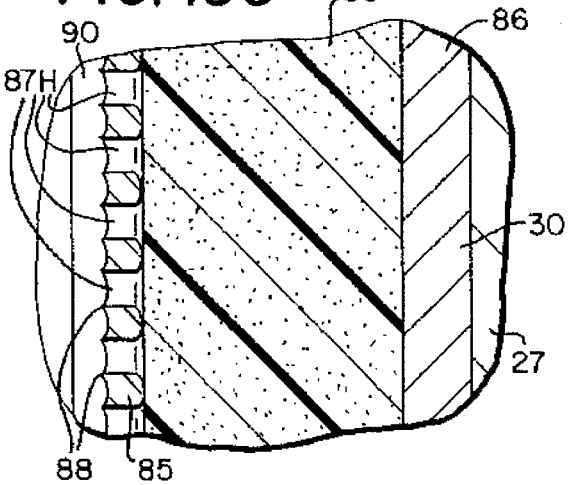
Figure 10D:
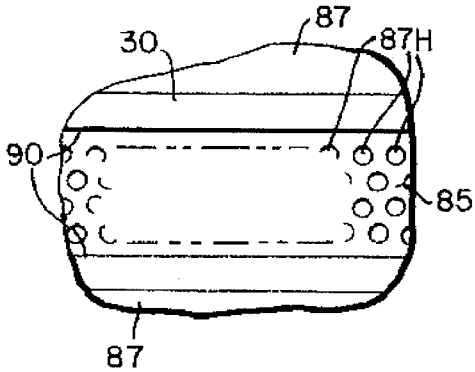

Referring again to FIGS. 10A–10D each groove channel member 30 mounted on the conical surface 29 of the stationary truncated cone member 27 is a "U" shaped metal member with the base 86 bonded to the conical surface 29. The channel members 30 are adjacent to each other at the top as shown in FIG. 10A and divergent from each other at the bottom of member 27 as shown in FIGS. 1 and 10D with a backing bonding material 87 inserted in the divergent space between the channel members. Each of the stainless steel ribbons 85 has through approximately forty percent of its area a uniform pattern of approximately one sixteenth diameter perforation holes 87H that leave sharp hole edges 88 on the outer facing side of the ribbon 85. The inner smooth side of each ribbon 85 is bonded to a backing strip layer 89 of sponge like resilient rubber 89 (or resilient plastic) with the stainless steel ribbons that are approximately sixty two thousandths of an inch thick being mounted with the outer face depressed approximately eighty thousandths of an inch from the outer edges 90 of the channel member 30. The backing strip layer 89 can be raw surgical rubber that as an uncured rubber acts like a resilient spring.

Figure 6A:
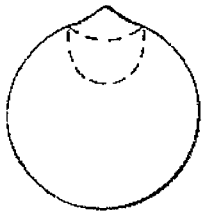
FIGS. 6A, B, C and D show successively, "A", a grain berry such as milo with an attach point, black shield, five layers of husk, a coating of wax and a germ, "B", the berry state with the black shield softened from short interval steam heating to approximately three hundred degrees on the berry periphery portion such that the wax shield breaks down and layers of husk loose their grip as the wax breaks down; "C", the grain berry germ separates with the black shield as the mill rubbing procedure begins and the layers of husk begin peeling with the continued rubbing action and, "D", the residual clean milo berry with the germ and all five layers of husk removed leaving the free of acid.
Figure 6B:
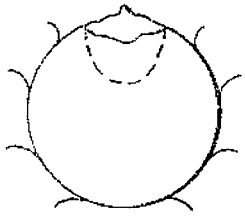
Figure 6C:
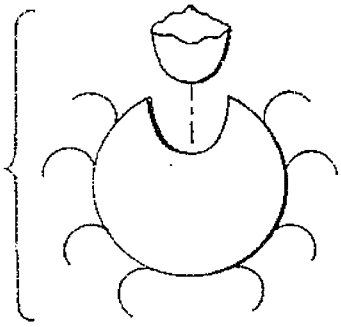
Figure 6D:
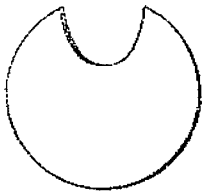

Mill processing of, for example, milo berries as shown in FIG. 6A intact with attach point, black shield, five layers of husks and a coating of wax and the germ all in place is transformed via the thermal shock treatment to softening of the black shield from quick steam heating of the berry outer layer along with wax shield break down. This results in layers of husk losing their grip as the wax breaks down. Thereafter the germ separates with the black shield as the rubbing procedure begins and layers of husk begin peeling and continue peeling to completion with the rubbing action. This results in clean milo berries with germ and all five layers of husk removed leaving the berries free of acid in the form of FIG. 6D.

Figure 7A:
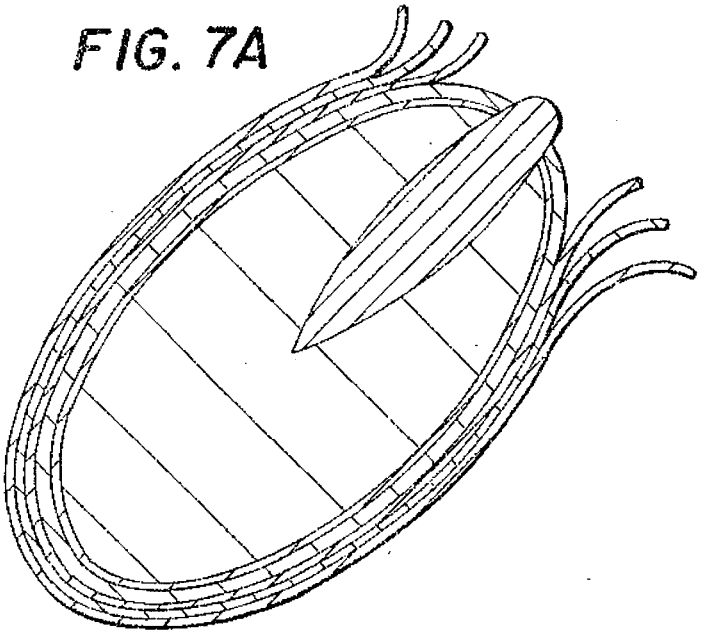
FIGS. 7A and 7B, 7A, a whole wheat kernel (or berry) with a first (Outermost brown husk; a second brown husk and a third brown husk, down to a transparent husk, and 7B, the wheat berry within the transparent husk with the out brown husks removed.
Figure 7B:
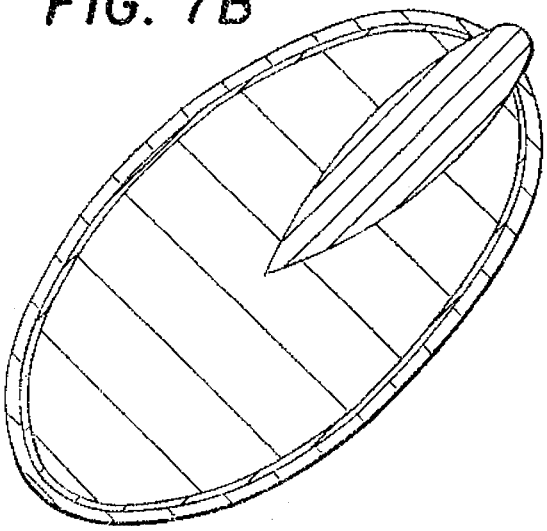
Figure 8:
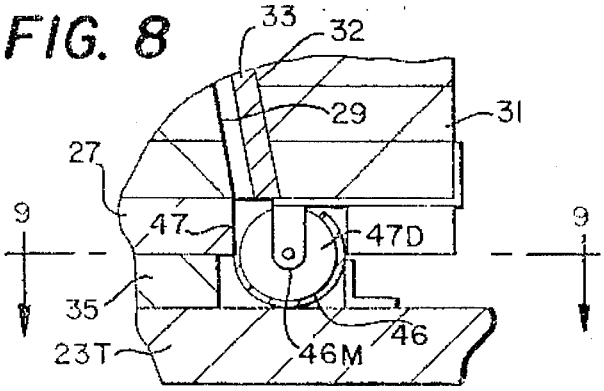
FIG. 8, a cut away and sectioned enlarged detail view like FIG. 5 rotationally displaced therefrom around the bottom portion of the grain rubbing section of the mill.
Figure 9:
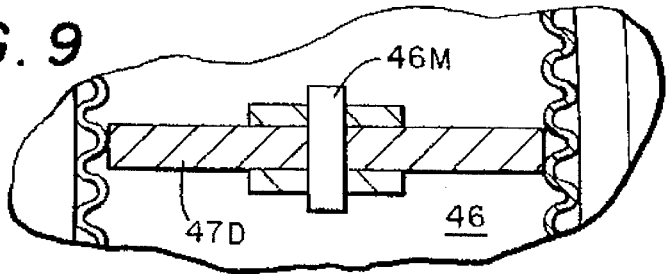
FIG. 9, a view taken from line 9—9 of FIG. 8 showing grain guide track scrubber baffle detail.

With respect to wheat the mill 20 is adjusted to take wheat in its milling action from the initial intact form of FIG. 7A to the desired finished form of 7B with the inner transparent layer in place retaining all the aletone powder in place along with the wheat germ. This provides a new type of flour that can be made from the de-acidized kernel. The de-acidizer has precision controls accurate enough to remove the outside layers of brand that are brown while leaving the inner transparent layer in place and delivering the whole berry undamaged. The whole berry with the transparent skin in place retains all the aletone powder in place including the wheat germ. When this whole berry is ground into flour the product becomes a white whole wheat flour without the bitters of the brown husk. The resulting flour is higher in fiber and more digestable because the aletone being included eliminates the harmful effect of gluten in the digestive track. Aletone is lost in the normal pre-existing milling process with crushing of the berry. The aletone that clings to the brand in earlier milling processes contains minerals and vitamins vital to digestion and balance against gluten (glue).

Whereas this invention has been described with respect to a single embodiment thereof, it should be realized that various changes may be made without departing from the essential contributions to the art made by the teachings hereof.

I claim:

1. A grain de-acidizing process mill comprising: grain storage and feed means; grain transverse movement means; grain fast heating means for heating the grain berry outer portion; high velocity relatively cold air stream delivery means: means for passing heated grain berries into said high velocity relatively cold air stream to temperature shock the heated grain outer portion and thereby cause a sudden contraction of grain berry outer portion layers causing then to crack and loosen from the grain core; rubbing action mill means for separating grain berry outer layers from the berry along with other portions to be removed; grain movement means for moving the grain from the high velocity relatively cold air stream to said rubbing action mill means; and a grain output guide track with flexible scrubber baffles therein sliding mill processed grain therein to final output means to mill processed grain berry storage means.

2. The grain de-acidizing process mill of claim 1, wherein said grain transverse movement means is an auger cylinder housing with an enclosed auger blade; motor drive means drive train connected to said auger blade; adjustable speed transmission means included in said drive train adjusted to a speed for delivering grain through said auger cylinder housing in the approximate range of from one half second to one and one half seconds.

3. The grain de-acidizing process mill of claim 2, wherein steam generating means is connected by steam line delivery means connected to the auger cylinder housing for quick heating of the outer portion of the grain by steam.

4. The grain de-acidizing process mill of claim 3, wherein water source means is connected to feed water to said steam generating means; power source means is connected to supply heating power to said steam generating means.

5. The grain de-acidizing process mill of claim 4, wherein temperature sensing means is connected to said auger cylinder housing and to temperature control means for quickly heating the outer portion of grain to approximately three hundred degrees fahrenheit.

6. The grain de-acidizing process mill of claim 5, wherein the auger cylinder housing is approximately twenty inches long with grain travel approximately fourteen inches therethrough, long enough and substantially horizontal such that temperature control regulated steam fed to a plurality of inlets along the auger cylinder housing as related to the rate of grain movement through the auger heats the outer portion of the grain being passed therethrough to the required temperature level.

7. The grain de-acidizing process mill of claim 6, wherein said high velocity relatively cold air stream delivery means includes a motor driven air blower developing a relatively cold air stream down through a blower output tube into which grain is passed from a grain discharge opening in said auger cylinder housing to be thereby temperature shocked.

8. The grain de-acidizing process mill of claim 4, wherein temperature sensing means is connected to said auger cylinder housing and to temperature control means for together controlling the supply of heating power to said steam generating means for quickly heating the outer portion of grain being process milled to within the temperature range of approximately two hundred seventy to three hundred thirty degrees fahrenheit.

9. The grain de-acidizing process mill of claim 8, wherein the auger cylinder housing is approximately twenty inches long with grain travel approximately fourteen inches therethrough, long enough and substantially horizontal such that temperature control regulated steam fed to a plurality of inlets along the auger cylinder housing as related to the rate of grain movement through the auger heats the outer portion of the grain being passed therethrough to the required temperature level.

10. A grain de-acidizing process mill comprising: grain rubbing action mill means including a truncated cone mill member and an outer grain mill member having an internal truncated conical surface conformed to the outer surface of said truncated cone mill member; said internal truncated conical surface and said outer surface of said truncated cone mill member mounting a layer of resiliently flexible material as a sheath bonded thereto space adjusting means for adjusting the space between the mill grain rubbing surfaces to the approximate range of from 0.069 inches to 0.096 inches as determined by grain berry size and its retention of transparent sheath and alerone powder; drive means driving said truncated cone mill member and said outer grain mill member in relative rotation; grain feed means; and quick temperature heating and quick temperature cooling means included with said grain feed means used in temperature shock treatment of grain being fed into said mill truncated cone and said outer grain mill interacting members.

11. The grain de-acidizing process mill of claim 10, wherein metal "U" shaped channel members are mounted on the other of the two truncated conical surfaces angled at approximately forty five degrees and extending from the truncated conical surface smaller diameter top to the wider diameter bottom of the conical mounting surface; and said metal "U" shaped channel members are curvilinear conformed to the conical mounting surface from side by side adjacency at the top diverging to divergent spacing at the bottom.

12. The grain de-acidizing process mill of claim 11, wherein said quick temperature heating means includes a steam heated auger, and said quick temperature cooling means includes a blower blowing ambient temperature air into the grain feed path in the mill structure.

13. The grain de-acidizing process mill of claim 12, wherein said steam heated auger is a transverse grain movement auger with a cylinder enclosed auger blade; motor output drive means drive train connected to said auger blade; adjustable speed transmission means included in said drive train adjusted to a speed delivering grain through said auger in the approximate range of from one half second to one and one half seconds; wherein steam generating means is connected by steam line delivery means connected to the auger cylinder for quick heating of the outer husk portion of the grain by steam.

14. The grain de-acidizing process mill of claim 13, wherein temperature sensing means connected to said auger cylinder and to temperature control means together controlling the supply of heating power to said steam generating means for quickly heating the outer portion of grain being process milled to within the temperature range of approximately two hundred seventy to three hundred thirty degrees fahrenheit.

* * * * *